US006908154B2

(12) United States Patent
Aono

(10) Patent No.: US 6,908,154 B2
(45) Date of Patent: Jun. 21, 2005

(54) FOLD-UP WHEELCHAIR AND ELEVATING APPARATUS OF THE SAME

(75) Inventor: Yukihiko Aono, Hamamatsu (JP)

(73) Assignee: Aono Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/731,154

(22) Filed: Dec. 10, 2003

(65) Prior Publication Data

US 2004/0160103 A1 Aug. 19, 2004

(30) Foreign Application Priority Data

Dec. 20, 2002 (JP) ..... 2002-370771

(51) Int. Cl.[7] ..... A47C 1/02

(52) U.S. Cl. ..... 297/330; 297/DIG. 4; 297/354.13; 280/650; 5/620

(58) Field of Search ..... 297/354.13, 330, 297/DIG. 4, DIG. 10; 280/642, 643, 647, 648, 650; 5/616, 623

(56) References Cited

U.S. PATENT DOCUMENTS

| | | | | |
|---|---|---|---|---|
| 4,809,804 A | * | 3/1989 | Houston et al. | 297/DIG. 4 |
| 4,834,411 A | * | 5/1989 | Willey et al. | 297/DIG. 4 |
| 6,173,461 B1 | * | 1/2001 | Alexander | 5/616 |
| 6,393,641 B1 | * | 5/2002 | Hensley | 5/616 |
| 6,428,103 B1 | * | 8/2002 | Hong | 297/354.13 |

FOREIGN PATENT DOCUMENTS

| | | |
|---|---|---|
| JP | 2001-145670 | 5/2001 |
| JP | 2002-177334 | 6/2002 |
| JP | 2002-369864 | 12/2002 |

* cited by examiner

*Primary Examiner*—Anthony D. Barfield
(74) *Attorney, Agent, or Firm*—Bacon & Thomas PLLC

(57) ABSTRACT

For easier care of a bed-ridden patient, a fold-up wheelchair comprises a chair main body (2) having a back rest, the chair main body being foldable upward and downward; rear frames (6) of the chair main body (2); rear legs (15) extending lower rearward, the rear legs being connected to a vertically middle portion of the rear frames (6) so as to be rotatable forward and rearward; extensible working bodies (16) connected to the rear legs (15) and upper end portions of the rear frames (6) so as to be rotatable forward and backward; a motor (17) operating the respective working bodies (16) so as to expand and contract synchronously, the motor being provided in an upper end portion of the working bodies (16); guides (24) arranged in right and left sides of the chair main body (2) so as to extend forward and backward, front and rear end potions thereof being supported by a pin; a rod (25) fitted to the guide (24) so as to be slidable forward and backward, a rear end portion of the rod (25) being connected to the rear legs (15) in such a manner as to be rotatable forward and backward; and a front wheel (26) and a rear wheel (27) respectively provided in a front lower portion of the chair main body (2) and a lower end portion of the rear legs (15).

1 Claim, 9 Drawing Sheets

FOLD-UP WHEELCHAIR AND ELEVATING APPARATUS OF THE SAME

BACKGROUND OF THE INVENTION

1. Field of the Invention

The present invention relates to a fold-up wheelchair and an elevating apparatus of the same, by which a caregiver having a poor physical strength such as an aged person or the like can easily second a bed-ridden patient or a patient having difficulty in walking.

2. Description of the Conventional Art

As a conventional art, there has been a fold-up wheelchair, in which a chair main body is formed by rotatably connecting side frames of a parallel link type to both right and left sides of a base frame and mounting a seat between both the side frames, a rear leg is rotatably connected to a rear frame of each of the side frames toward a rear lower direction, a screw shaft being movable in a forward and backward direction is connected to the side frames and the rear legs, and the chair main body is made into a surface shape or a chair shape by moving the screw shaft forward and backward (for example, refer to Japanese Unexamined Patent Publication No. 2002-177334 (page 1)).

Further, there has been a fold-up wheelchair in which a chair main body is formed by rotatably connecting side frames of a parallel link type to both right and left sides of a base frame and mounting a seat between both the side frames, a rear leg is rotatably connected to a rear frame of each of the side frames toward a rear lower direction, a screw shaft being movable in an upward and downward direction is connected to a vertically middle portion of the rear frame and a vertically middle portion of the rear leg, and the chair main body is made into a surface shape or a chair shape by moving the screw shaft forward or backward (for example, refer to Japanese Unexamined Patent Publication No. 2001-145670 (page 1)).

Further, there has been an elevating apparatus (a stacker) structured such that a load carrying platform on which the fold-up wheelchair mentioned above can be mounted is attached to a rising mast in such a manner as to be freely movable upward and downward, and the load carrying platform is moved upward and downward by a motor-driven winch (for example, refer to a non-patent document, Mechanical Engineering Manual Sixth Revision, page 44 and FIG. 148 in Section 16, written by Japan Society of Mechanical Engineers Corporation, issued on Mar. 20, 1982).

In the structures in the patent documents Nos. 2001-177334 and 2001-145670 mentioned above, when being folded up, the mounting surface forms into the surface shape and descends, whereby it is possible to transfer the patient in bed between the bed (futon) and the wheelchair by a comparatively small labor. Further, when expanding to the chair shape under this state, the normal wheelchair is formed, and it is possible to easily move the patient mentioned above to a bath or a lavatory. However, when receiving the patient in the bath under a state of mounting on the wheelchair, the whole of the screw shaft and the tube body engaged with the screw shaft are immersed in a hot water. Accordingly, it is impossible to directly connect a driving motor to the screw shaft, it is necessary to rotate the screw shaft by engaging an independent power jig, and an operation becomes complicated. Further, the screw shaft rusts easily by the hot water, and it is impossible to stabilize the operation of the screw shaft for a long time period.

In the non-patent document mentioned above, since the load carrying platform and the fold-up wheelchair mounted on the load carrying platform are always moved upward and downward in a horizontal state, there is a limit to transfer the patient between the bed (futon) and the wheelchair by less labor. An object of the present invention is to provide a novel fold-up wheelchair and an elevating apparatus of the same which can solve the problems mentioned above.

SUMMARY OF THE INVENTION

The present invention is structured in the manner mentioned below in order to achieve the object mentioned above. In accordance with a first aspect of the present invention, there is provided a fold-up wheelchair comprising:

a chair main body having a back rest, the chair main body being foldable upward and downward;

right and left rear frames of the chair main body;

a pair of right and left rear legs extending lower rearward, the rear legs being connected to a vertically middle portion of the rear frames so as to be rotatable forward and rearward;

extensible working bodies connected to the rear legs and upper end portions of the right and left rear frames so as to be rotatable forward and backward;

a motor operating the respective working bodies so as to expand and contract synchronously, the motor being provided in an upper end portion of the working bodies;

guides arranged in right and left sides of the chair main body in such a manner as to extend forward and backward, front and rear end potions thereof being supported by a pin;

a rod fitted to the guide so as to be slidable forward and backward, a rear end portion of the rod being connected to the rear legs in such a manner as to be rotatable forward and backward; and a front wheel and a rear wheel respectively provided in a front lower portion of the chair main body and a lower end portion of the rear legs.

Further, in accordance with a second aspect of the present invention, there is provided a fold-up wheelchair, further comprising:

a receiving table for supporting the fold-up wheelchair;

an upward and downward driving apparatus for moving the receiving table in an upward and downward direction; and a tilting apparatus provided in an upper portion of the upward and downward driving apparatus and rotating the receiving table around one of right and left edge portions.

DESCRIPTION OF THE PREFERRED EMBODIMENT

Figure 3:
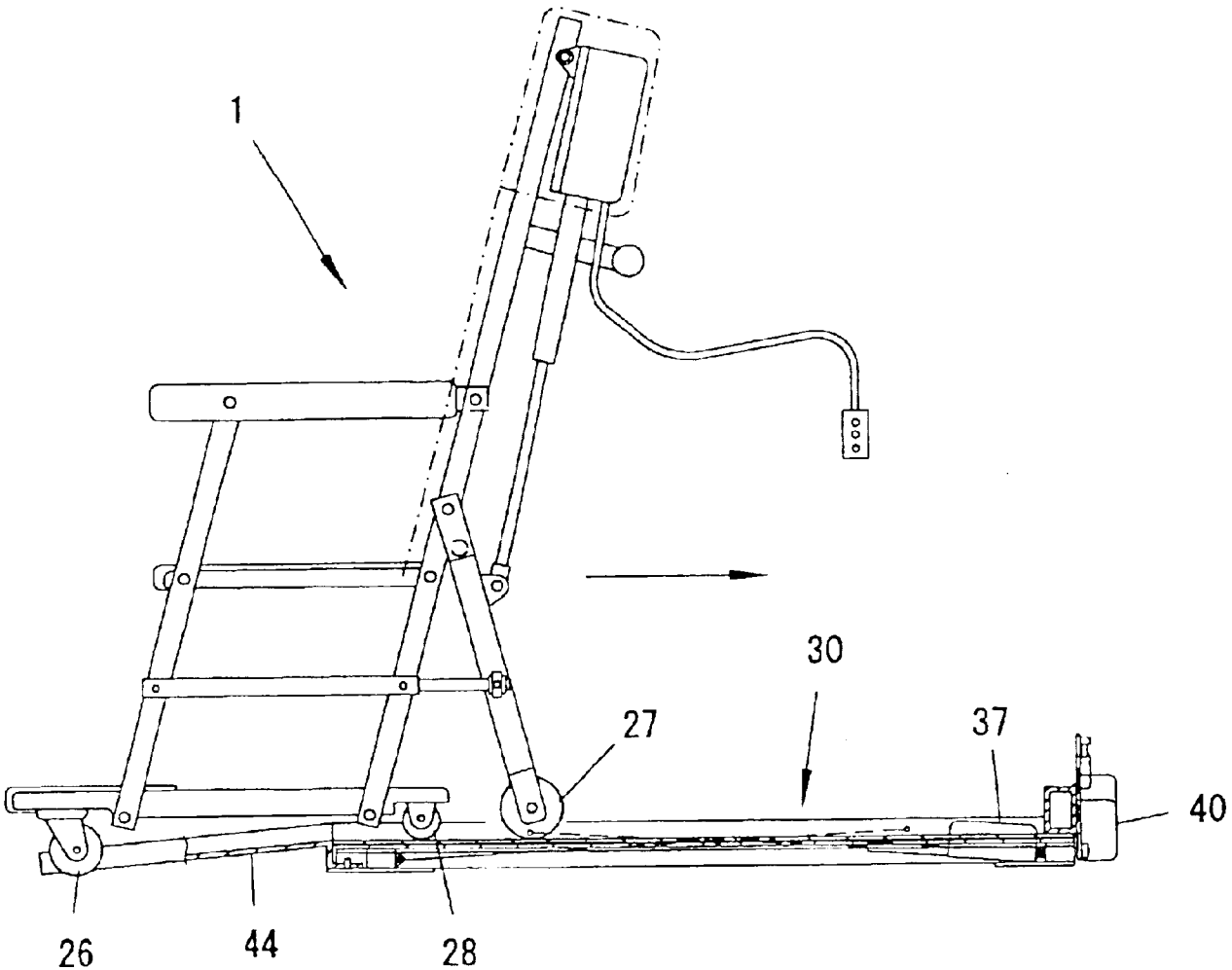
FIG. 3 is a partly cross sectional side view showing a state in which the risen wheelchair is mounted to an elevating apparatus.
Figure 4:
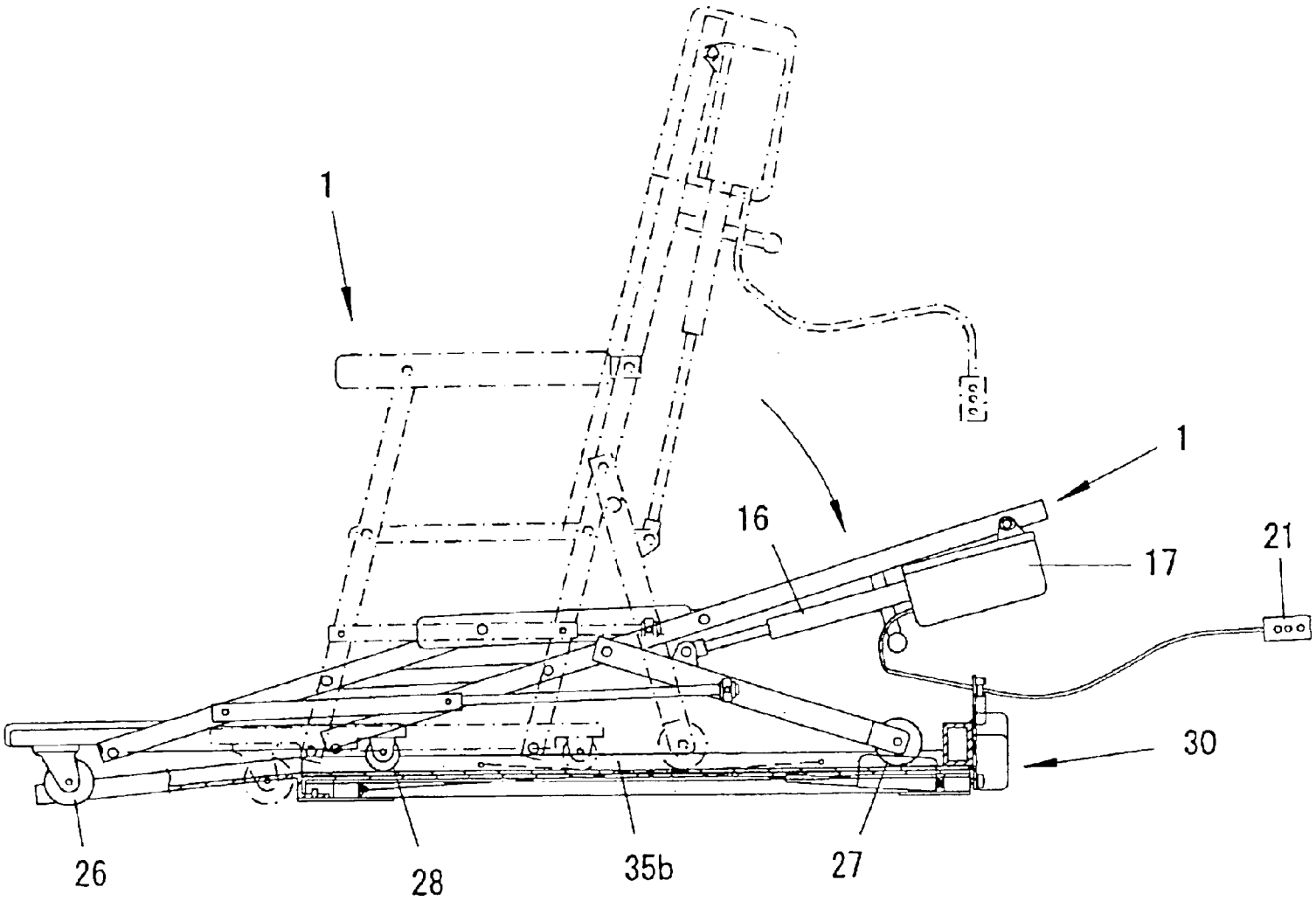
FIG. 4 is a partly cross sectional side view showing a state in which the wheelchair is folded up on the elevating apparatus.
Figure 5:
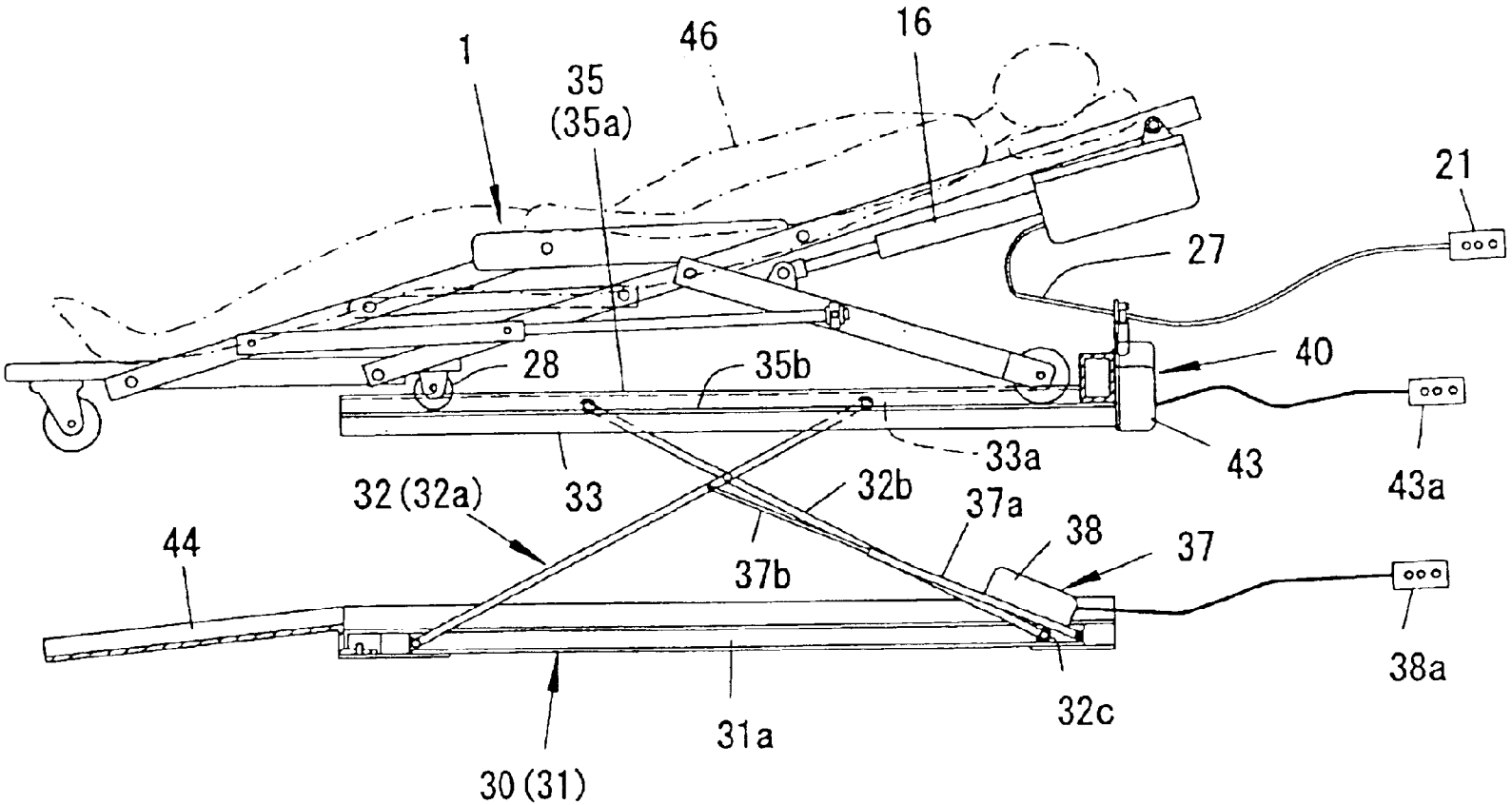
FIG. 5 is a partly cross sectional side view showing an upward moving state of the elevating apparatus.
Figure 6:
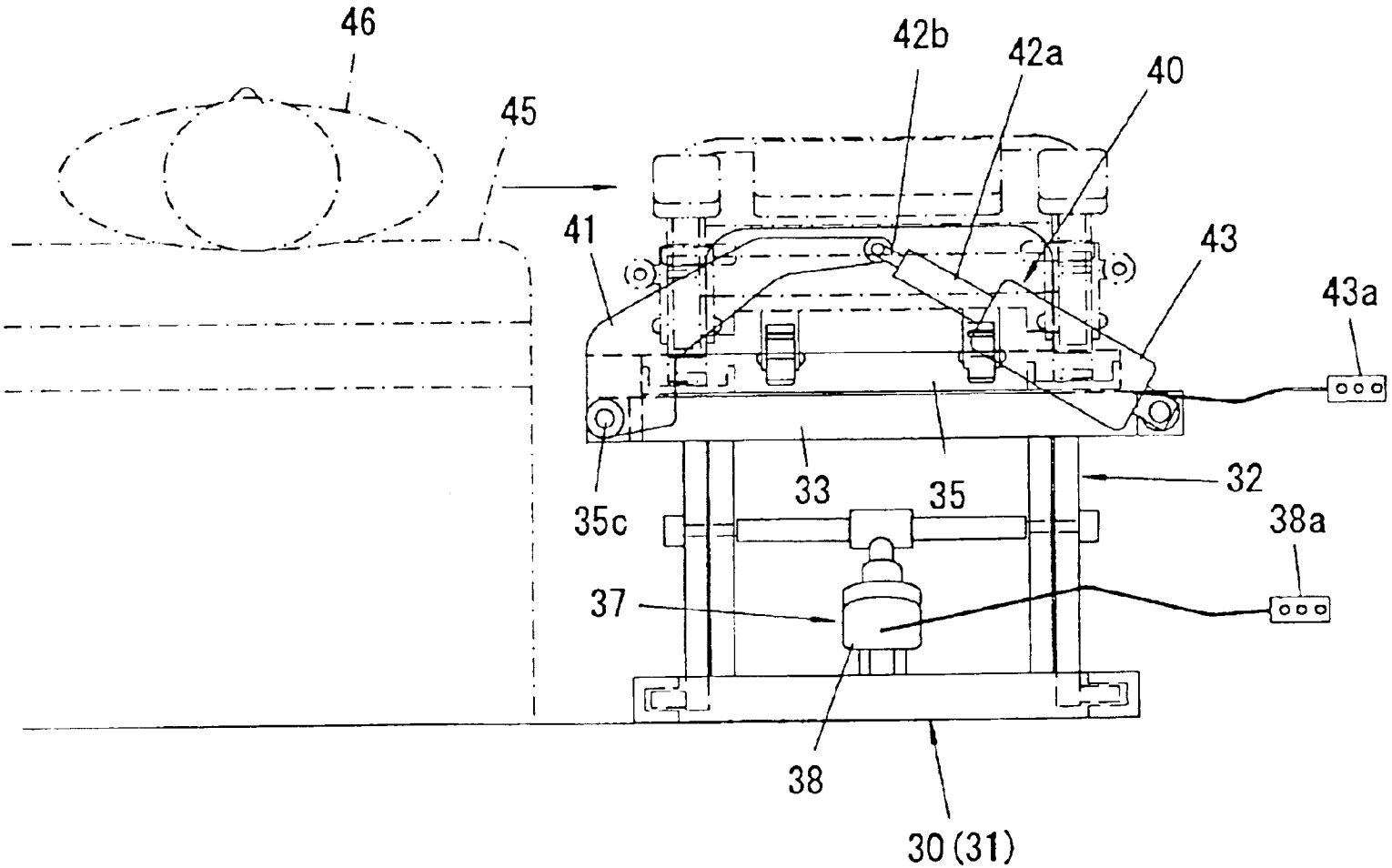
FIG. 6 is a back view of FIG. 5.
Figure 7:
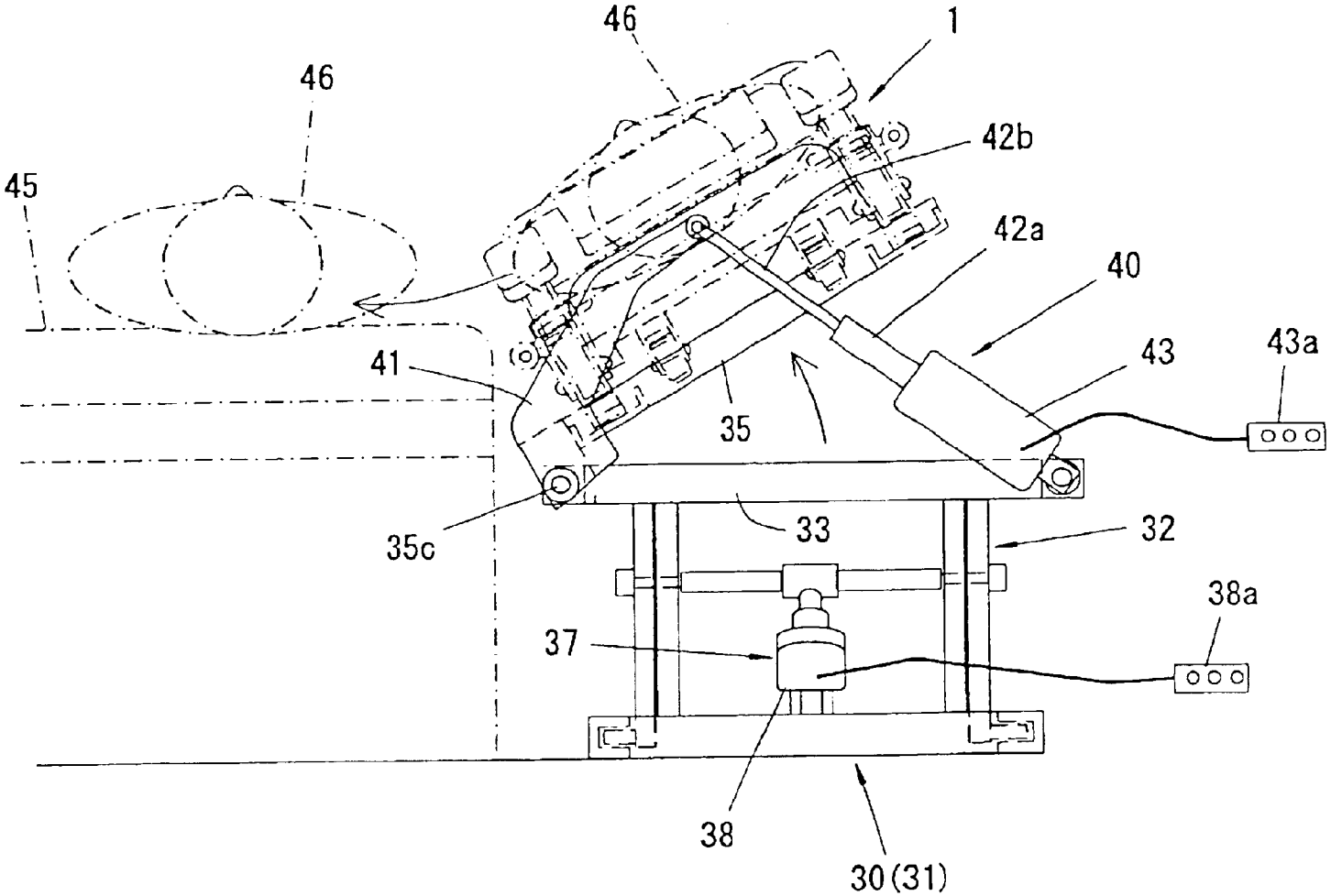
FIG. 7 is a back view showing a state in which a patient is transferred between a bed and the wheelchair.
Figure 8:
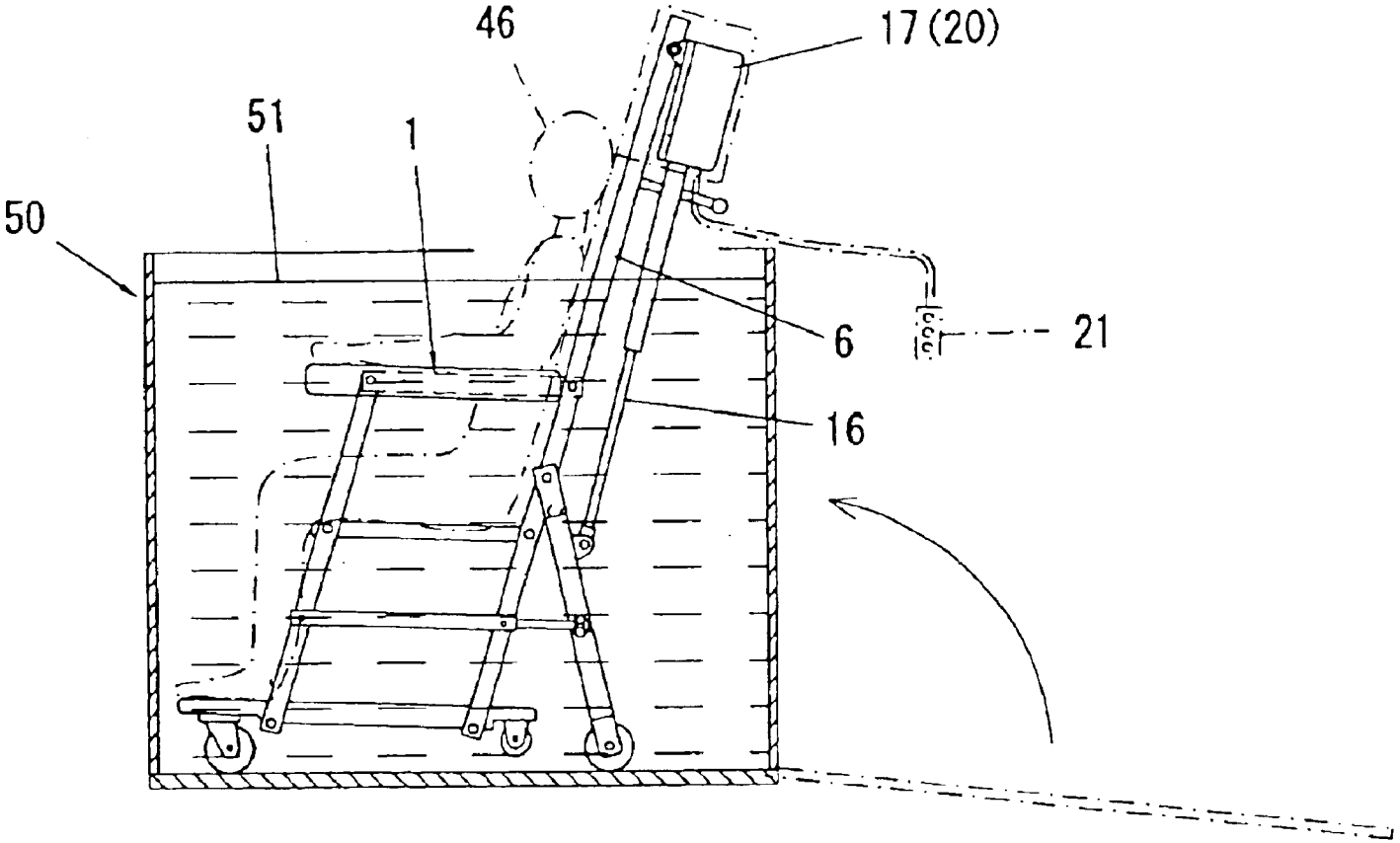
FIG. 8 is a partly cross sectional side view showing a state in which the patient mounted on the wheelchair takes a bath.
Figure 9:
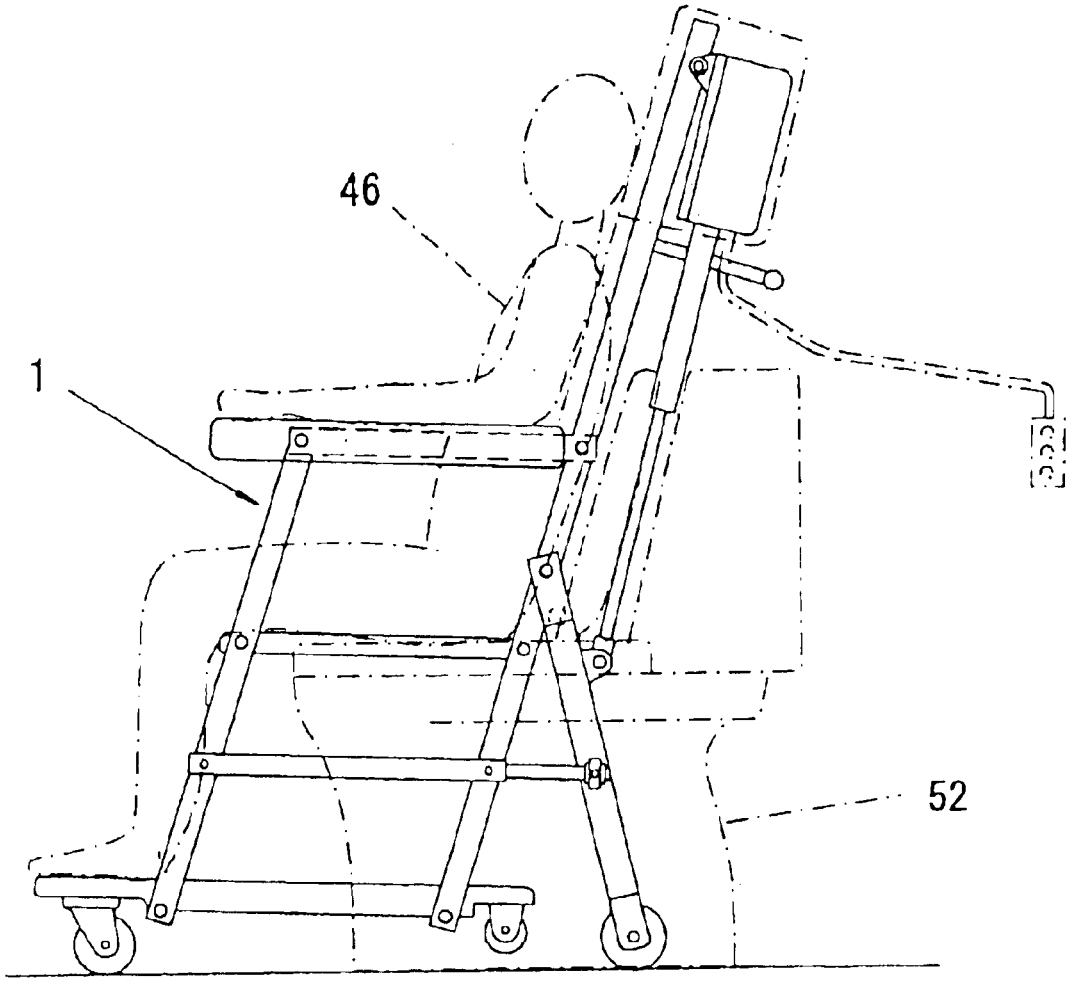
FIG. 9 is a side view showing a state in which the patient mounted on the wheelchair uses a toilet bowl.

A description will be given below of an embodiment in accordance with the present invention with reference to the accompanying drawings. In the drawings, FIG. 1 is a side elevational view showing an expanded state of a wheelchair in accordance with the present invention, FIG. 2 is a back elevational view of FIG. 1, FIG. 3 is a partly cross sectional side elevational view showing a state in which the expanded wheelchair is mounted to an elevating apparatus, FIG. 4 is a partly cross sectional side elevational view showing a state in which the wheelchair folded up on the elevating apparatus, FIG. 5 is a partly cross sectional side elevational view showing an upward moving state of the elevating apparatus, FIG. 6 is a back elevational view of FIG. 5, FIG. 7 is a back elevational view showing a state in which a patient is transferred between a bed and the wheelchair, FIG. 8 is a partly cross sectional side elevational view showing a state in which the patient mounted on the wheelchair has a bath, and FIG. 9 is a side elevational view showing a state in which the patient mounted on the wheelchair evacuates the bowels.

Figure 1:
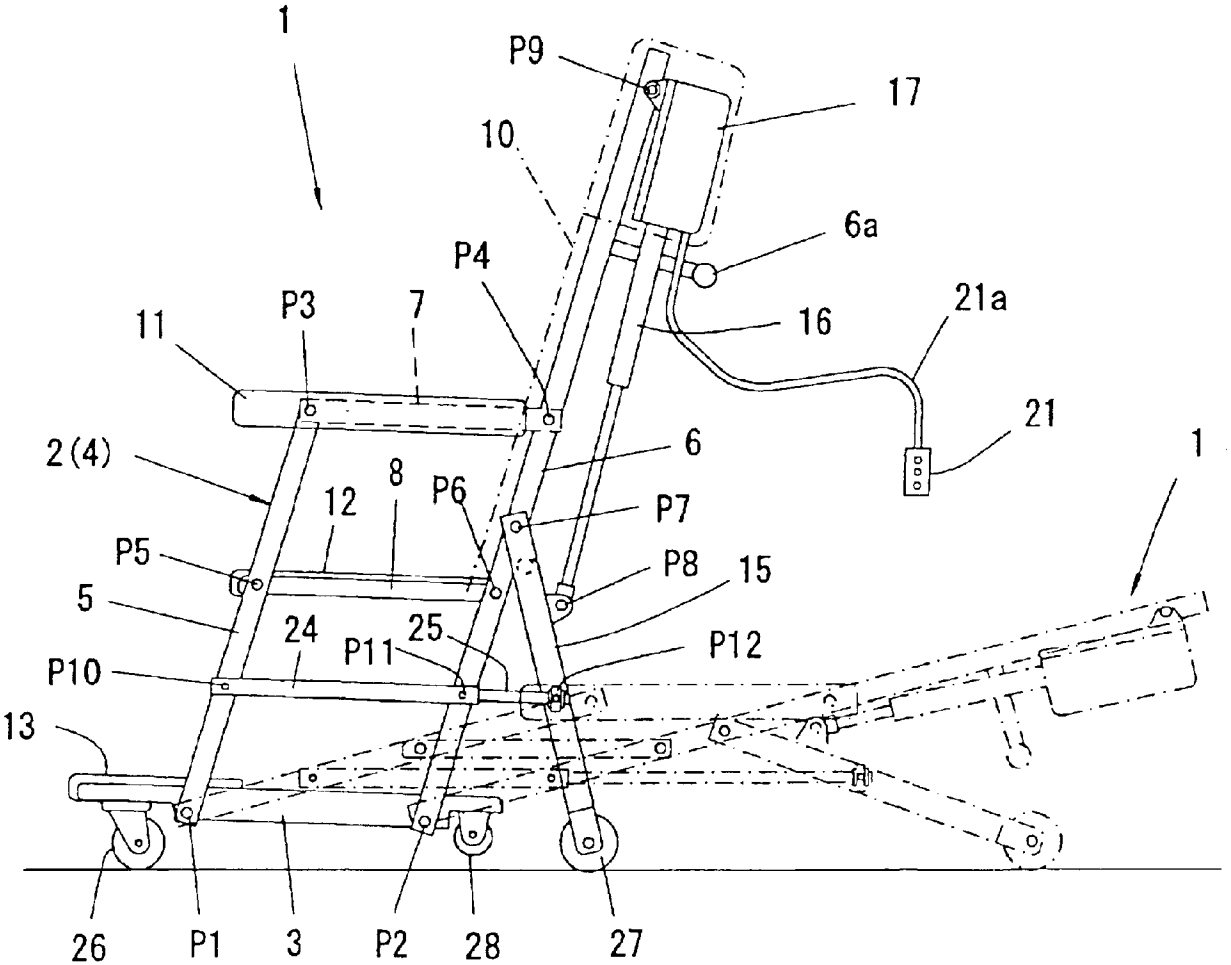
FIG. 1 is a side view showing a rising state of a wheelchair in accordance with the present invention.
Figure 2:
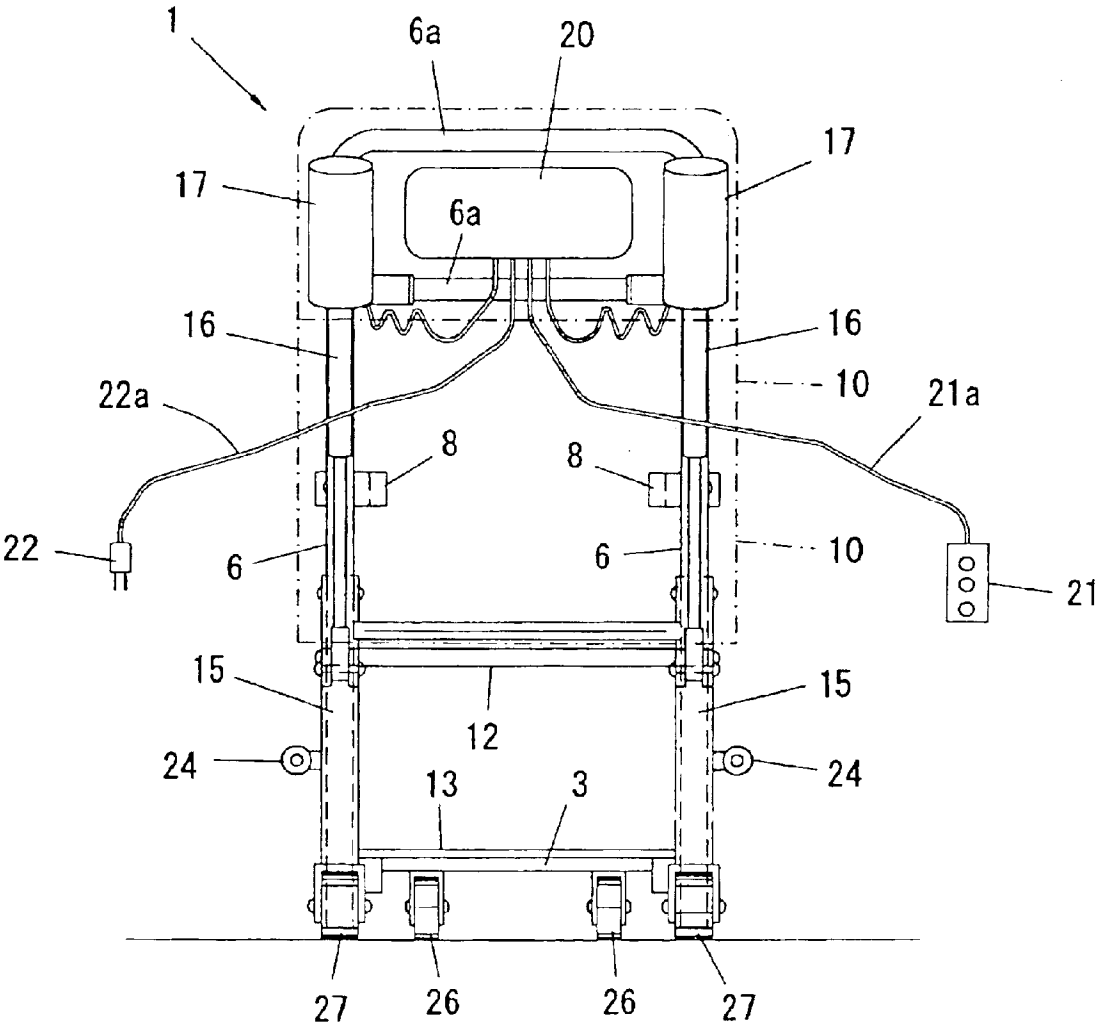
FIG. 2 is a back view of FIG. 1.

In FIGS. 1 and 2, reference numeral 1 denotes a fold-up wheelchair, and reference numeral 2 denotes a chair main body of the wheelchair. The chair main body 2 is provided with a fork-shaped base frame 3 in which a rear side is divided into two sections, and is structured such that a pair of parallel link side frames 4 and 4 are rotatably connected to right and left sides of the base frame 3. In details, front frames 5 and 5 and rear frames 6 and 6 are connected to both sides in a front portion of the base frame 3 and both sides in a rear portion thereof respectively by supporting point pins (supporting point axes) P1 and P2 in such a manner as to be rotatable forward and backward so as to rise in parallel longitudinally, and arm rest frames 7 and 7 and seat frames 8 and 8 which are parallel to the base frame 3 are connected between the front frames 5 and 5 and the rear frames 6 and 6 by supporting point pins P3 to P6 so as to be apart from each other vertically.

The right and left rear frames 6 and 6 are integrally connected by bending a rectangular pipe in an inverse-U shape, and are protruded largely to an upper side with respect to the front frame 5, and a back rest 10 made of a sheet is detachably mounted to the protruding portions. A grip portion 6*a* is mounted to a rear surface side of upper portions of the right and left rear frames 6 and 6. Further, an arm rest 11, a seat 12 and a foot rest 13 which are made of plastic are mounted respectively to the arm rest frame 7, the seat frame 8 and a front portion of the base frame 3. In this case, the seat 12 has a toilet hole (not shown) which can be opened and closed, in a center portion thereof.

Rear legs 15 and 15 are connected to the vertical middle portions of the right and left rear frames 6 and 6 mentioned above via supporting point pins P7 so as to freely rotate forward and backward, they are rotated to a rear downward direction, expandable telescopic working bodies 16 and 16 are respectively connected to the vertical middle portions of the rear legs 15 and 15 and the upper end portions of the right and left rear frames 6 and 6 via supporting point pins P8 and P9 so as to freely move forward and backward, and motors 17 and 17 for operating the working bodies 16 and 16 so as to expand and contract are mounted to the respective upper end portions of the working bodies 16 and 16.

A control box 20 (FIG. 2) which contains a battery and a control apparatus is mounted to an upper end portion between the respective rear frames 6 and 6, and the motors 17 and 17 mentioned above are connected to the control box 20. Further, lead wires 21*a* and 22*a* are extended out from the control box 20, a remote control switch 21 and a charging plug 22 are respectively connected to leading end portions of the lead wires 21*a* and 22*a*, the right and left working bodies 16 and 16 are synchronously expanded and contracted by operating the remote control switch 21, and the battery within the control box 20 is charged by inserting the plug 22 into a socket outlet of 100 volt power source.

A tubular guide 24 is mounted to each of the right and left side frames 4 and 4 mentioned above. In details, the guide 24 is arranged in a vertical middle portion between the base frame 3 and the seat frame 8 in parallel thereto, and the front and rear ends thereof are rotatably connected to the front frame 5 and the rear frame 6 via supporting point pins P10 and P11. Further, a rod 25 is fitted to the guide 24 in such a manner as to be slidable forward and backward, and a rear end portion of the rod 25 is rotatably connected to a lower portion of each of the rear legs 15 and 15 via a supporting point pin P12. Accordingly, it is possible to prevent the rear legs 15 and 15 from shaking.

Further, front wheels 26 and 26 constituted by casters are mounted to a front end portion of the base frame 3, rear wheels 27 and 27 are mounted to lower end portions of the rear legs 15 and 15, and small-diameter auxiliary wheels 28 and 28 are mounted to a rear end portion of the base frame 3, whereby the fold-up wheelchair 1 in accordance with the present invention is structured. In this case, an interval between the right and left front wheels 26 and 26 is set smaller than an interval between the rear wheels 27 and 27 as shown in FIG. 2, and a vertical position of the auxiliary wheels 28 and 28 is set slightly higher than a position of the rear wheels 27 and 27 as shown in FIG. 1.

The fold-up wheelchair 1 mentioned above is moved in a vertical direction and inclined at a predetermined angle in a transversal direction by an elevating apparatus 30, as shown in FIGS. 3 to 7. The elevating apparatus 30 supports an elevating table 33 to a supporting table 31 via an X-shaped parallel link mechanism 32 so as to be freely movable upward and downward, and supports a receiving table 35 to the elevating table 33 so as to be tiltable transversely, as shown in FIG. 5.

In details, the supporting table 31 is framed in a oblong rectangular shape in a front-rear direction by bar members, and lower guide grooves 31*a* in a front-rear direction is formed by right and left bars constituted of mutually opposing channel steels. Further, the parallel link mechanism 32 is structured such that front and rear link rods 32*a* and 32*b* are crossed in an X shape and connected by pin, a lower end of the front link rod 32*a* is connected by pin to a front portion (a left portion in FIG. 5) side of the supporting table 31, and the link rod 32*b* in a rear portion side is engaged with a rear portion (a right portion in FIG. 5) side of the lower guide groove 31*a* via a roller 32*c* so as to be slidable forward and backward.

The elevating table 33 mentioned above is formed in a rectangular shallow cover shape by a steel plate so as to be able to cover an upper side of the supporting table 31 and to be freely set to and unset from the supporting table 31, guide grooves 33*a* extending in a longitudinal direction is formed by fixing opposing channel steels to right and left lower surfaces thereof, and front and rear upper end portions of the parallel link mechanism 32 is engaged with the upper guide grooves 33*a* via rollers (reference numeral is omitted) in such a manner as to be slidable forward and backward.

Further, the receiving table 35 is framed in an oblong rectangular shape in a front-rear direction by bar members and mounted on the elevating table 33. Right and left bar members 35*a* of the receiving table 35 are formed in an upward groove cross sectional shape so as to constitute longitudinal wheel guide grooves 35*b* on which the rear wheels 27 and the auxiliary wheels 28 of the fold-up wheelchair 1 mentioned above roll. A right side (a left side in FIG. 6) of the receiving table 35 is rotatably connected to a right side of the elevating table 33 via a supporting point axis 35*c*, and the receiving table 35 can rotate upward (laterally) around the supporting point axis 35*c*, as shown in FIG. 7.

The parallel link mechanism 32 is operated in a vertical direction by a telescopic driving apparatus 37. In details, as shown in FIG. 5, a right end (a rear end) of a guide tube 37*a* is connected by pin to a rear side of the supporting table 31 so as to be freely rotatable upward and downward, a working rod 37*b* is slidably fitted to the guide tube 37*a*, a left end (a front end) of the working rod 37*b* is connected by pin to an intersecting portion of the parallel link mechanism 32 so as to freely rotatable upward and downward, a motor 38 is mounted to a base portion of the guide tube 37*a*, and the working rod 37*b* is moved into and from the guide tube 37*a* by the motor 38, whereby the parallel link mechanism 32 is operated in a vertical direction, so that the elevating table 33 is moved in a vertical direction. Reference symbol 38*a* denotes a remote control switch for controlling the driving operation of the motor 38.

Further, the receiving table 35 mentioned above is rotated laterally around a horizontal line by a tilting apparatus 40. In details, as shown in FIGS. 6 and 7, the rear side supporting point axis 35*c* among the rear side supporting point axes for connecting the receiving table 35 to the elevating table 33 is fixed to the receiving table 35, and an arm 41 is fixed to the supporting point axis 35*c* so as to extend upper rightward. Further, a guide tube 42*a* is connected by pin to a right end portion in FIG. 6 of the elevating table 33, a working rod 42*b* is slidably fitted to the guide tube 42*a*, a leading end (an upper end) of the working rod 42*b* is connected by pin to a leading end portion of the arm 41, and a motor for operating the working rod 42*b* is mounted to a base portion of the guide tube 42*a*.

Further, the arm 41 is rotated in a counterclockwise direction so as to rotate the receiving table 35 upward around the supporting point axis 35*c*, that is, incline sideward with respect to the elevating table 33, as shown in FIG. 7, by the working rod 42*b* being pushed out from the guide tube 42*a* by the motor 43. In this case, in FIG. 6, in the case of moving a patient 46 to the wheelchair 1 in a left side of a bed 45, the receiving table 35 is rotated in a clockwise direction (a right direction) in FIG. 6 by setting the lateral rotating direction of the receiving table 35 to be opposite to that in FIG. 6, that is, setting the supporting point axis 35*c* of the receiving table 35 and the mounting position of the tilting apparatus 40 to be mirror reversed to that mentioned above. Reference symbol 43*a* denotes a remote control switch for controlling a driving operation of the motor 43. In FIG. 5, reference numeral 44 denotes a slope detachably mounted to a front portion of the supporting table 31 mentioned above. The slope 44 is provided for guiding the rear wheel 27 and the auxiliary wheel 28 at a time of mounting the wheelchair 1 to the elevating apparatus 30.

Next, a description will be given of a using aspect of the embodiment mentioned above. First, at a time of transferring the patient 46 on the bed 45 shown in FIG. 6 to the wheelchair 1, the wheelchair 1 is expanded into a chair shape as shown in FIG. 1, the elevating apparatus 30 is folded up into a surface shape as shown in FIG. 3, and the wheelchair 1 is mounted backward on the elevating apparatus 30, as shown by imaginary lines in FIGS. 3 and 4.

Next, the remote control switch 21 in a side of the wheelchair 1 is operated, whereby the right and left working bodies 16 are operated via the motor 17 so as to be contracted, and the wheelchair 1 is folded up into the surface shape on the elevating apparatus 30, as shown by solid lines in FIG. 4. In this state, the working rod 37*b* of the driving apparatus 37 in the side of the elevating apparatus 30 is operated so as to be extended, whereby as shown in FIGS. 5 and 6, the elevating table 33 is ascended via the parallel link mechanism 32, and the height of the folded-up wheelchair 1 is ascended to a slightly lower position than the bed 45. In this state, the patient 46 on the bed 45 is moved in a lateral direction so as to be mounted on the wheelchair 1. At this time, it is preferable to employ a commercially available moving sheet (not shown) structured such that a sheet is formed in a loop type and a sliding agent is coated on an inner surface thereof.

Next, after the driving apparatus 37 is operated so as to be contracted and the wheelchair 1 is descended, the working body 16 in the side of the wheelchair 1 is operated so as to be expanded, whereby the wheelchair 1 is expanded into the chair shape as shown in FIG. 1, and the wheelchair 1 is removed from the elevating apparatus 30. At this time, each of the rear legs 15 and 15 of the wheelchair 1 expanded into the chair shape is reinforced by the guide 24 and the rod 25 connecting the respective right and left side frames 4 and 4 to the rear legs 15 and 15, whereby a horizontal shake can be prevented.

Accordingly, it is possible to receive the patient 46 mounted on the wheelchair 1 in a bath tab 50 together with the wheelchair 1, as shown in FIG. 8, and to give the patient 46 a bath by supplying hot water 51 to the bath tab 50. In this case, since the motor 17 for driving the working bodies 16 of the wheelchair 1 and the control box 20 are positioned in the upper end portion of the rear frame 6, these parts do not soak into the hot water 51, and can be prevented from being damaged. Further, as shown in FIG. 9, a rear side of the wheelchair 1 can be fitted to a toilet bowl 52, and it is possible to make the patient 46 use the toilet bowl in a state of mounting the patient 46 on the wheelchair 1.

As mentioned above, at a time of returning the patient 46 to the bed 45 after seconding for giving the patient 46 a bath, making the patient 46 use a toilet bowl, and the like is finished, the reverse operation to the operation mentioned above is carried out, and the height of the patient 46 on the wheelchair 1 is ascended to the height of the bed 45 as shown in FIG. 6. Thereafter, as shown in FIG. 7, the working rod 42*b* of the tilting apparatus 40 is operated so as to be extended, the receiving table 35 is rotated in the counterclockwise direction around the supporting point axis 35*c*, and the fold-up wheelchair 1 mentioned above is tilted sideward down to the bed 45 together with the patient 46. In this state, the patient 46 on the wheelchair 1 is transferred to the bed 45. In accordance with the operation mentioned above, it is possible to move the patient 46 on the wheelchair 1 to the bed 45 by smaller labor. At this time, the same moving sheet (not shown) as mentioned above may be employed.

As is apparent from the above description, in accordance with the invention as recited in the first aspect of the present invention, it is possible to fold up the wheelchair in the surface shape, and it is easy to transfer the patient between the bed (futon) and the wheelchair. Further, since the motor and the upper portion of the working body driven by the motor are positioned above the hot water within the bath tab, at a time when the wheelchair is expanded in the seat shape and received in the bath tab, durability becomes high. Further, the respective rear legs of the wheelchair expanded in the seat shape are reinforced by the guides and the rods connecting the respective right and left side frames to the rear legs, and the horizontal shake is prevented.

Further, in accordance with the invention as recited in the second aspect, the structure is made such that the wheelchair is stably lifted up and tilted toward the bed. Accordingly, it is possible to transfer the patient between the wheelchair and the bed by small labor, and even a caregiver having a poor physical strength such as an aged person or the like can easily second the patient being bed-ridden or having difficulty in walking.

What is claimed is:

1. A fold-up wheelchair comprising:

a chair main body (2) having a back rest, said chair main body being foldable upward and downward;

right and left rear frames (6) of said chair main body (2);

a pair of right and left rear legs (15) extending lower rearward, said rear legs being connected to a vertically middle portion of the rear frames (6) so as to be rotatable forward and rearward;

extensible working bodies (16) connected to the rear legs (15) and upper end portions of said right and left rear frames (6) so as to be rotatable forward and backward;

a motor (17) operating the respective working bodies (16) so as to expand and contract synchronously, said motor being provided in an upper end portion of said working bodies (16);

guides (24) arranged in right and left sides of the chair main body (2) in such a manner as to extend forward and backward, front and rear end potions thereof being supported by a pin;

a rod (25) fitted to said guide (24) so as to be slidable forward and backward, a rear end portion of said rod (25) being connected to said rear legs (15) in such a manner as to be rotatable forward and backward; and a front wheel (26) and a rear wheel (27) respectively provided in a front lower portion of said chair main body (2) and a lower end portion of said rear legs (15).

* * * * *